US005528841A

United States Patent [19]

Pozzobon

[11] Patent Number: 5,528,841

[45] Date of Patent: Jun. 25, 1996

[54] SPORTS SHOE WITH VENTILATED, PADDED INTERIOR

[75] Inventor: Alessandro Pozzobon, Paderno di Ponzano Veneto, Italy

[73] Assignee: Nordica S.p.A., Trevignano, Italy

[21] Appl. No.: 244,112

[22] PCT Filed: Sep. 8, 1993

[86] PCT No.: PCT/EP93/02432

§ 371 Date: May 18, 1994

§ 102(e) Date: May 18, 1994

[87] PCT Pub. No.: WO94/06317

PCT Pub. Date: Mar. 31, 1994

[30] Foreign Application Priority Data

Sep. 23, 1992 [IT] Italy ..... TV92A0104

[51] Int. Cl.[6] ..... A43B 7/06; A43B 5/04; A43B 23/00

[52] U.S. Cl. ..... 36/3 A; 36/115; 36/45

[58] Field of Search ..... 36/115, 54, 55, 36/71, 3 R, 3 A, 45, 117, 118, 119, 120, 121, 3 B

[56] References Cited

U.S. PATENT DOCUMENTS

| | | | |
|---|---|---|---|
| 3,858,337 | 1/1975 | Vogel | 36/55 |
| 4,095,355 | 6/1978 | Annovi | 36/71 X |
| 4,458,429 | 7/1984 | Schmid | 36/54 X |
| 4,507,880 | 4/1985 | Ohashi | 36/3 R X |
| 4,771,555 | 9/1988 | Ohashi | 36/3 A X |
| 5,171,033 | 12/1992 | Olson et al. | 36/3 R X |
| 5,339,545 | 8/1994 | Paris | 36/55 X |
| 5,342,070 | 8/1994 | Miller et al. | 36/3 A X |
| 5,357,695 | 10/1994 | Lu | 36/3 R X |

FOREIGN PATENT DOCUMENTS

| | | | |
|---|---|---|---|
| 0350103 | 1/1990 | European Pat. Off. | 36/3 R |

*Primary Examiner*—B. Dayoan
*Attorney, Agent, or Firm*—Guido Modiano; Albert Josif

[57] ABSTRACT

A ventilated sports shoe, particularly usable for skates which are constituted by a frame for supporting two or more wheels and the shoe. The shoe has a plurality of through seats and a plurality of soft pads can be arranged within the seats and protrude inside the shoe, so as to constitute a soft protective region for the user's foot and leg as well as a channel for the air inside the shoe.

10 Claims, 2 Drawing Sheets

SPORTS SHOE WITH VENTILATED, PADDED INTERIOR

BACKGROUND OF THE INVENTION

The present invention relates to a sports shoe, particularly for skates.

Conventional skates, for example of the type with two or more aligned wheels, are essentially constituted by a shoe associated with a wheel supporting frame.

The shoe, or boot, is generally constituted by a quarter articulated to a shell and is usually made of plastics.

An innerboot can be arranged inside the shell and the quarter, and constitutes a padding element to improve the user's comfort.

These conventional skates have the drawback that they do not allow a transpiration, because the foot is enclosed within a substantially tight container, so as to cause considerable sweating during the use of the skate.

This drawback is strongly felt by the users, since this sport is predominantly practiced in summer.

As a partial solution to this drawback, a skate with aligned wheels is commercially known and comprises a plurality of internal ventilation openings.

However, in this type of skate it is necessary to use an innerboot made of transpiring fabric in order to allow adequate ventilation.

Even this solution has drawbacks, since in any case the air does not optimally flow inside the sports shoe, thus limiting beneficial effects for the user.

Furthermore, the openings have fixed arrangements and sizes and therefore the user is not able to vary the degree of ventilation flow according to his own specific requirements, which are due to the different types of sweating of different individuals, to the different types of use of the skate, and to the particular season in which the skate is used.

SUMMARY OF THE INVENTION

The aim of the present invention is to overcome the drawbacks described above in conventional skates by providing a sports shoe which allows optimum ventilation of the user's foot.

Within the scope of the above aim, an important object is to provide a sports shoe in which the user can select the degree of ventilation according to his own specific requirements or according to requirements related to the particular season in which it is used or to the particular type of use of the skate (slalom or speed skating).

Another important object is to provide a sports shoe wherein optimum comfort for the user can be achieved together with optimum ventilation.

Another important object is to provide a sports shoe in which ventilation can affect one or more parts of the foot and of the user's leg, said user being able to preset and vary these regions.

Another object is to provide a ventilated sports shoe having low manufacturing costs, and which is structurally simple and easy to industrialize.

This aim, these objects and others which will become apparent hereinafter are achieved by a sports shoe particularly for skates, characterized in that it comprises a plurality of through seats for engaging a plurality of pads which protrude at least inside said shoe.

BRIEF DESCRIPTION OF THE DRAWINGS

Further characteristics and advantages of the present invention will become apparent from the detailed description of a particular but not exclusive embodiment thereof, illustrated only by way of non-limitative example in the accompanying drawings, wherein.

DESCRIPTION OF THE PREFERRED EMBODIMENTS

Figure 3:
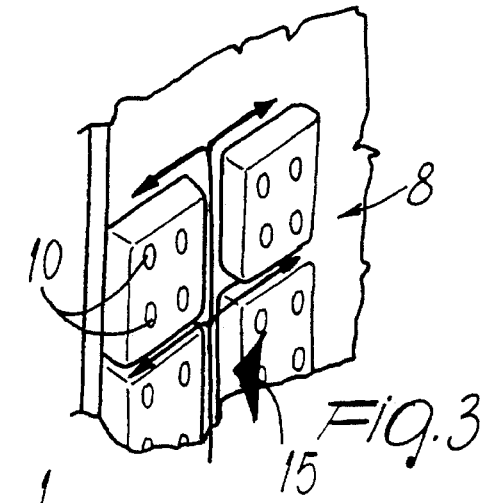
FIG. 3 is a detail view of the internal lateral surface of the shoe.
Figure 2:
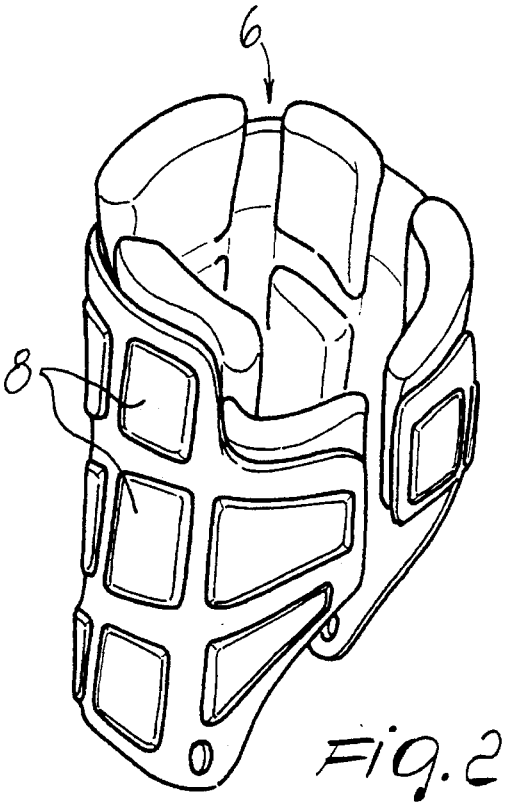
FIG. 2 is a lateral perspective view of the quarter of the shoe.
Figure 1:
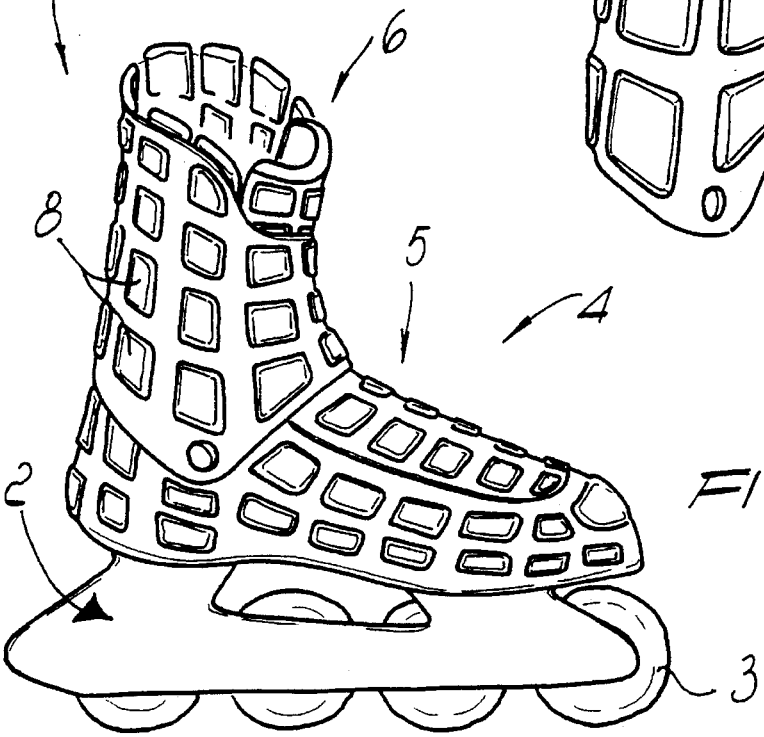
FIG. 1 is a side view of the sports shoe according to the present invention.
Figure 4:
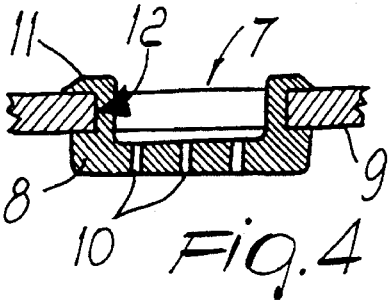
FIGS. 4 and 5 are cross section views of the shoe, illustrating the shape of the through seats of the pads associable thereat, according to two different embodiments of the invention.

With reference to the above figures, the reference numeral 1 designates a skate which comprises a frame 2 for supporting two or more mutually aligned wheels 3 and a shoe, or boot, 4.

The shoe is constituted by a quarter 6 articulated to a shell 5.

A plurality of through seats 7 is formed both at the quarter 6 and at the shell 5.

One or more pads, designated by the reference numeral 8, can be arranged at one or more of said seats 7. The pads are made of soft material and protrude at least inside the internal lateral surface 9 of the shell 5 and of the quarter 6, so as to constitute the internal padding for the shoe 4.

As an alternative, the pads 8 may be associated at the seats 7 by molding.

Their position is thus fixed and defined during design.

The pads 8 may have a plurality of holes 10 connected to the seats 7, so as to allow the flow of air in and out of the shell and the quarter.

Optionally, the pads 8 may be detachable by means of adapted elastically deformable wings 11 which engage the edges 12 of the seats 7 in a snap-together manner.

Figure 5:
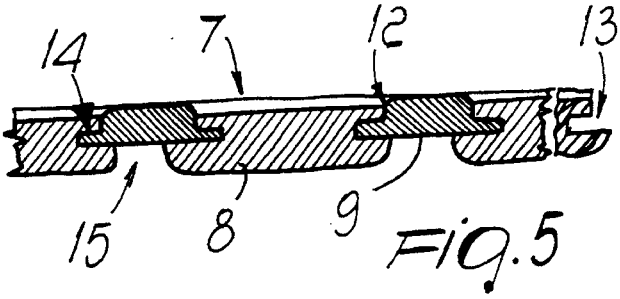

As an alternative, as shown in FIG. 5, the pads 8 may be perimetrically provided with an annular groove 13 for engaging tabs 14 which protrude from the perimetric edges 12 of the seats 7.

A channel 15 for the circulation of air inside the shoe 4 is thus formed between a plurality of mutually adjacent pads 8.

The present invention allows the user to arrange the pads 8 at the desired seat 7, formed on the shell 5 or on the quarter 6, for example so as to select the points where air intakes from outside have to be provided, and this is done according to the type of sport to be practiced and to the season in which said practice occurs, as well as according to the individual transpiration characteristics of the foot.

Furthermore, the air flow inside the shoe can be throttled by using pads 8 having holes 10 so as to create regions having a different amount of air inflow.

Furthermore, since the pads 8 protrude inside the internal lateral surface 9 of the quarter 6 and of the shell 5, on one hand they form the padding for the item of footgear, thus no longer requiring the use of an adapted innerboot, and on the other hand they define a channel 15 which allows the optimum outflow or inflow of air while maintaining optimum comfort for the user.

Figure 6:
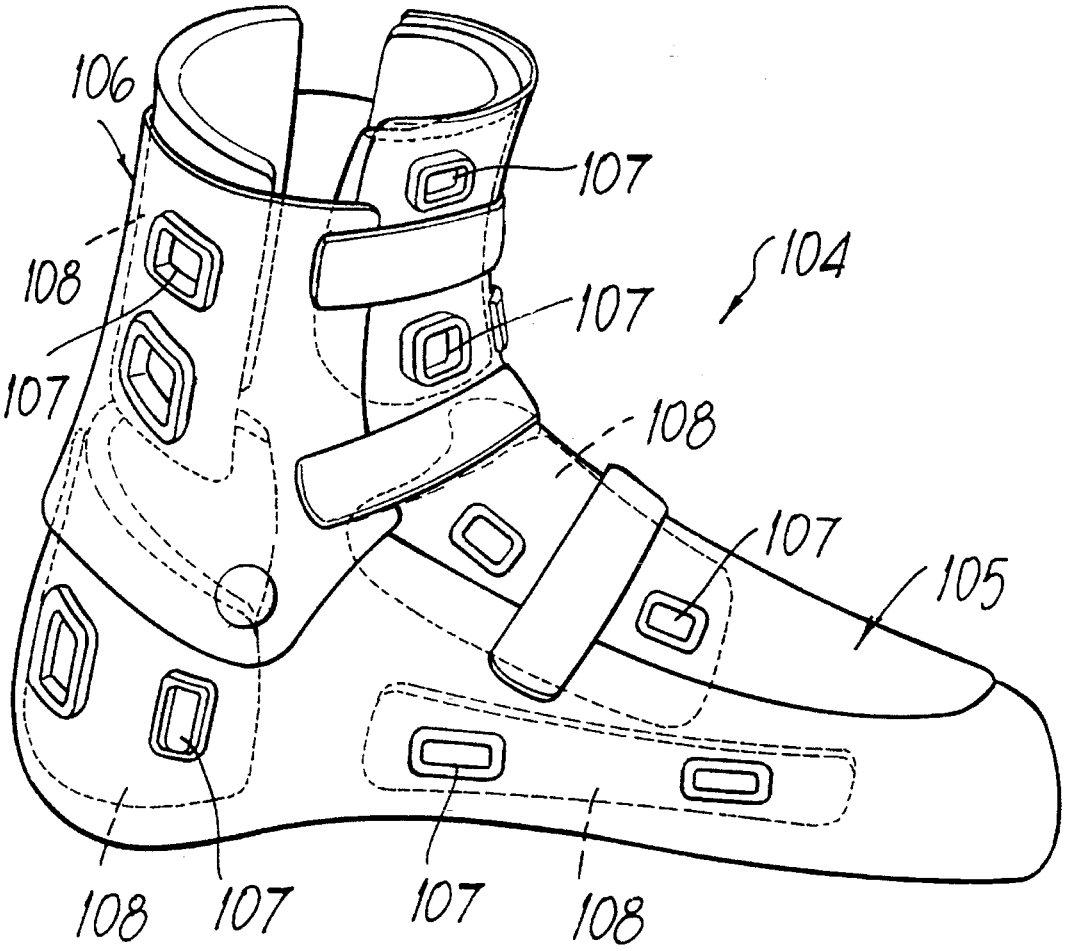
FIG. 6 is a side view of a shoe according to a further aspect of the invention.

FIG. 6 illustrate a sports shoe 104, according to a further aspect of the invention, comprising a quarter 106 articulated to a shell 105.

The shoe 104 comprises a plurality of through seats 107 adapted to engage a plurality of pads 108, substantially as described above.

In this case however, the number of seats 107 is reduced with respect to the number of seats 7 of the above described shoe 4.

The number of internal pads 108 is even lesser and each pad 108 engages more than one seat 107, as clearly illustrated in FIG. 6. This embodiment has the advantage of reducing the time for assembling the pads both at the production stage and for the user.

It has thus been observed that the invention has achieved the intended aim and objects, a sports shoe having been provided in which it is possible to obtain an optimum internal ventilation, and this is provided in a manner which is customized according to the specific requirements of the user or according to the sport practiced or to weather conditions.

It is also possible to select regions of higher or lower air inflow or outflow and, by means of the channels 15 and, optionally, of the holes 10 formed on the pads 8, to facilitate the air flow where it is mostly required.

All this allows optimum foot transpiration, thus improving user comfort.

Furthermore, the structure allows to eliminate the innerboot, thus reducing the manufacturing and assembly costs of the sports shoe.

The sports shoe according to the invention is naturally susceptible to numerous modifications and variations, all of which are within the scope of the same inventive concept.

The dimensions and the materials which constitute the individual components of the shoe may also be the most pertinent according to the specific requirements.

What is claimed is:

1. Sports shoe comprising a shell, a quarter connected to said shell, a plurality of through seats formed in said shell and in said quarter, and a plurality of pads connected to said plurality of through seats, said pads protruding inside said sports shoe from said plurality of through seats formed in said shell and in said quarter, and a plurality of air circulation channels defined inside said sports shoe on said shell and on said quarter between said plurality of pads.

2. Sports shoe according to claim 1, further comprising edges defined by each through seat of said plurality of through seats, and releasable connection means for connecting said plurality of pad members to said plurality of through seats, said releasable connection means comprising elastically deformable wings connected to said pads and engageable with said edges in snap-together engagement therewith.

3. Sports shoe according to claim 1, further comprising releasable connection means for connecting said plurality of pads to said through seats, said releasable connection means comprising a perimetric groove defined on each of said pads, a perimetric edge defined by each of said seats, and tabs protruding from said perimetric edge of each of said seats, said perimetric groove of one of said pads being engageable with said tabs protruding from said perimetric edge of one of said seats.

4. Sports shoe according to claim 1, wherein one of said pads is connected to at least two of said through seats.

5. Sports shoe according to claim 1, wherein at least one of said pads has formed therein a plurality of air flow through holes.

6. In combination, a sports shoe comprising a shell, a quarter connected to said shell, a plurality of through seats formed in said shell and in said quarter, a plurality of pads selectively connected to said plurality of through seats, and means for selectively releasably connecting said plurality of pads to said plurality of through seats formed in said shell and in said quarter, said pads protruding inside said sports shoe from said plurality of through seats formed in said shell and in said quarter, and a plurality of air circulation channels defined inside said sports shoe on said shell and on said quarter between said pads, whereby padding and air circulation channels are providable within said sports shoe according to a wearer's specific requirements.

7. Combination shoe according to claim 6, wherein said means for selectively releasably connecting said plurality of pads to said plurality of through seats comprise edges defined by each of said through seats, and elastically deformable wings connected to said pads and engageable with said edges in snap-together engagement therewith.

8. Combination shoe according to claim 6, wherein said means for selectively releasably connecting said plurality of pads to said plurality of through seats comprise a perimetric groove defined on each of said pads, a perimetric edge defined by each of said seats, and tabs protruding from said perimetric edge of each of said seats, said perimetric groove of one of said pads being engageable with said tabs protruding from said perimetric edge of one of said seats.

9. Combination shoe according to claim 6, wherein one of said pads is connected to at least two of said through seats.

10. Combination shoe according to claim 6, wherein at least one of said pads has formed therein a plurality of air flow through holes.

* * * * *